United States Patent [19]

Berggren et al.

[11] 4,401,873

[45] Aug. 30, 1983

[54] MICROWAVE HEATING DEVICE WITH TAPERED WAVEGUIDE

[75] Inventors: Benny Berggren, Vällingby; Göran Böling, Täby, both of Sweden

[73] Assignee: Stiftelsen Institutet For Mikrovagsteknik, Stockholm, Sweden

[21] Appl. No.: 208,004

[22] Filed: Nov. 18, 1980

[30] Foreign Application Priority Data

Nov. 28, 1979 [SE] Sweden ..... 7909825

[51] Int. Cl.[3] ..... H05B 6/70

[52] U.S. Cl. ..... 219/10.55 A; 219/10.55 F

[58] Field of Search ..... 219/10.55 A, 10.55 F, 219/10.55 M, 10.55 R, 10.55 D

[56] References Cited

U.S. PATENT DOCUMENTS 2,467,230 4/1949 Revercomb et al. ..... 219/10.55 A 3,474,209 10/1969 Parker ..... 219/10.55 A X 3,570,391 3/1971 Rejler ..... 219/10.55 A

*Primary Examiner*—B. A. Reynolds

*Assistant Examiner*—Philip H. Leung

*Attorney, Agent, or Firm*—LeBlanc, Nolan, Shur & Nies

[57] ABSTRACT

A device for microwave heating, including a wave guide, in which a material is intended to be heated, and a microwave source connected to the wave guide. The wave guide includes a portion wherein its cross-sectional area decreases continuously from the end of that portion located closest to the microwave source to the other end of the portion part, and along that portion the wave guide includes a portion with a geometry, at which fed-in microwave energy no longer can propagate in the wave guide, i.e., the wave guide proceeds continuously to so-called cut off at a certain distance from the narrower end of the part.

3 Claims, 2 Drawing Figures

MICROWAVE HEATING DEVICE WITH TAPERED WAVEGUIDE

BACKGROUND OF THE INVENTION

This invention relates to a device for microwave heating.

At microwave heating of material with relatively low microwave losses, i.e. low effect absorption, the microwave applicator in most cases must be designed with an unpractically great length.

It is difficult, moreover, at the heating of oblong material with low microwave losses to achieve a uniform effect absorption.

The present invention eliminates the aforesaid shortcomings.

The power $P_T$ transported along an applicator decreases according to $e^{-2\alpha x}$ of the function, where $\alpha$ is a constant depending on the microwave losses of the material and the geometry of the applicator, and x is the length coordinate of the applicator.

The power absorbed per length unit in the material can be written as $$P_f = \partial P_T / \partial x = 2\alpha e^{-2\alpha x}$$

where $\alpha$ is a relatively small number at materials with low microwave losses.

As an example can be mentioned, that a material with a low dielectricity constant $\epsilon = 2$ and with the loss angle tan $\delta = 0.001$ which is heated in a normal waveguide with a width = 60 mm at a frequency = 2450 MHz, after 10 m still has absorbed only about 65% of the power supplied.

The transported power $P_T$ can be expressed as stored energy (W) per length unit (1) times propagation velocity ($V_g$)

$$P_T = W/1 \cdot V_g$$

At constant transported power, thus, the stored energy W per length unit increases when the propagation velocity $V_g$ decreases.

The aforesaid can be read, for example, from Collin: "Field Theory of Guided Waves", chap. 9.6.

By holding $V_g$ sufficiently small, it is thus possible to increase $\alpha$ to a value acceptable for obtaining a reasonable applicator length.

A waveguide, however, proceeds to cut-off when $V_g$ proceeds to zero, and is near cut-off when $V_g$ is small. Therefore the risk is great that supplied power is reflected totally already before it has arrived at the material to be heated.

SUMMARY OF THE INVENTION

The present invention relates to a device for microwave heating which comprises a waveguide, in which a material is intended to be heated, and a microwave source, which is connected to the waveguide.

The invention is characterized in that the waveguide at least has one part where its cross-sectional area decreases continuously from the part end located closest to the microwave source to the other end of the part, and that the waveguide along said part incluces a portion with a geometry, at which microwave energy fed-in no longer can propagate in the waveguide, i.e. that the waveguide continuously proceeds to so-called cut-off at a certain distance from the narrower end of the said part.

Figure 1:
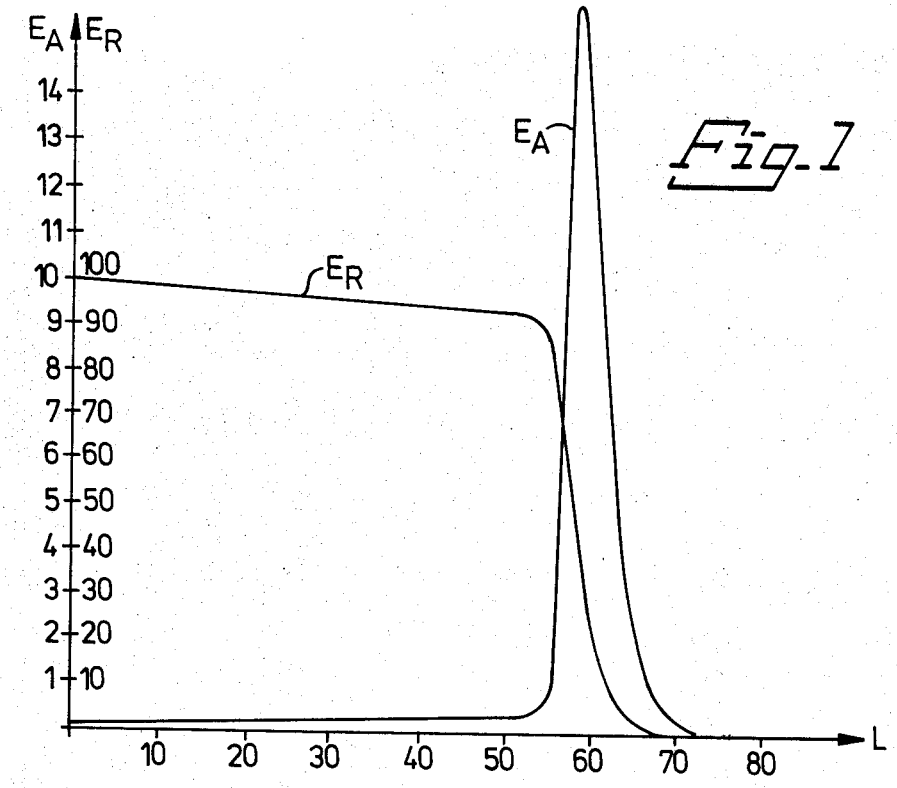
Figure 2:
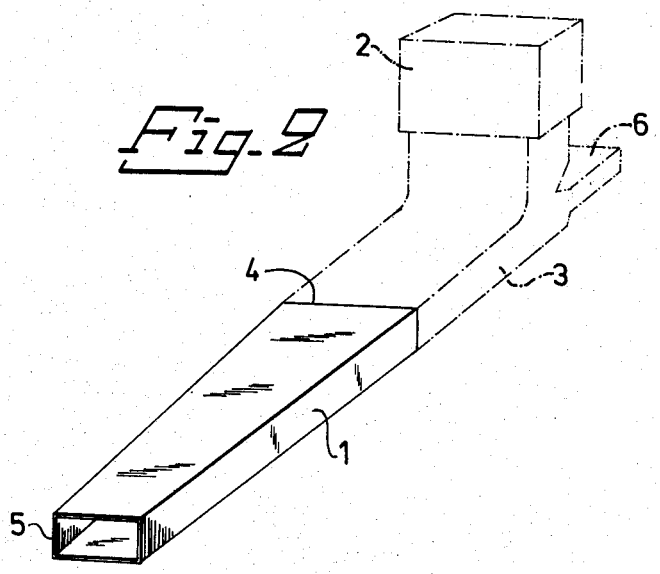

The invention is described in greater detail in the following, with reference to the accompanying drawing, in which FIG. 1 is a diagram showing absorbed and residual effect at a heating example, and FIG. 2 shows by way of example an embodiment of the device according to the invention.

According to the present invention, the device for microwave heating comprises a waveguide, which includes a part, along which the waveguide is designed to slowly and continuously proceed to cut-off. As an example, a waveguide 1 is shown in FIG. 2 where such a part constitutes the entire waveguide. The power is fed into the waveguide by means of a microwave generator 2 via a second waveguide 3, which are only schematically shown by dashed lines, at the wider end 4 of the waveguide 1. The present invention, however, is not restricted to a feed-in of energy in the way indicated in FIG. 2, but other known ways of feeding energy into a waveguide can be utilized in connection with a device according to the present invention.

The wider end 4 of the waveguide, for example, may have a width of 60 mm, its narrower end 5 a width of 30 mm, and its length may be 1000 mm.

The said part according to a preferred embodiment has rectangular or square cross-section, which decreases from the end 4 to the other end 5, where each cross-section is uniform with remaining cross-sections. The cross-section also may be circular.

The geometry of the waveguide 1, thus, is changed continuously along its length, or at least along a part of its length, which implies that it slowly and continuously proceeds to cut-off and that no reflection to the feed-in end occurs.

The effect absorption in a material heated in the waveguide 1 takes place, due to the waveguide design, in a top at the cut-off position of the waveguide. This top can be propagated and, respectively, concentrated by decreasing and, respectively, increasing the change of geometry per length unit of the waveguide.

For elucidation is mentioned, that the term cut-off here is understood to be the geometry, at which microwave energy, without regard to losses, cannot longer propagate in the waveguide.

At use, the material to be heated is fed-in at one end 6 of said waveguide 3, in which the energy is passed to the waveguide 1 according to the invention. As the material is transported through the waveguide and out of its narrower end 5 at substantially constant speed, an extremely uniform heating of the material is obtained.

If desired, a waveguide 1 preferably can be used also at the feed-in end for the material to be heated, in which case the narrower end 5 of the waveguide 1 is the feed-in end. Hereby leakage radiation is effectively prevented even at the feed-in end.

In FIG. 1 $E_A$ is shown on one axis which represents absorbed power per cm in percent of fed-in power, and further $E_R$ is shown which represents residual power in the waveguide in percent of fed-in power. On the other axis the longitudinal axis L of the waveguide is shown in cm, counted from the feed-in end.

FIG. 1 shows by way of example curves for a material with $\epsilon = 2.0$ and tan $\delta = 0{,}001$ which is heated in a waveguide having the dimensions indicated with reference to FIG. 2.

It appears clearly from FIG. 1, that the greater part of the power is absorbed by the material to be heated on a relatively short distance, viz. about the cut-off position of the waveguide. It also is apparent that both the absorbed power and the residual power decrease to zero before the end of the waveguide, which implies that no microwave energy leaks out from the narrower end of the waveguide.

It is, thus possible by means of a waveguide proceeding continuously to cut-off to transfer microwave energy to a material with low losses on a short distance. In addition, a waveguide is obtained which is insensitive to varying load. A variation in the material constants of the load merely implies that the cut-off position of the waveguide is displaced along the length of the waveguide, whereby also the absorption top is displaced in a corresponding manner.

The waveguide preferably is designed so that its cut-off position well lies within the waveguide, i.e. that a certain distance exists between the cut-off position of the waveguide and the narrower end 5 thereof. Said distance, according to a preferred alternative, can be 20–60% of the waveguide length, preferably 30–50% of the waveguide length. Such a design implies that no leakage radiation occurs at the narrower end 5 of the waveguide.

The invention idea described above, according to which an efficient heating is achieved, by utilizing a waveguide proceeding continuously to cut-off, on a short distance, and a relatively load-insensitive waveguide is obtained, and leakage radiation is eliminated, of course, must not be regarded restricted to the embodiment shown.

The invention, thus, can be varied in many ways within its scope defined in the attached claims.

We claim:

1. A device for microwave heating, comprising: a wave guide in which a material is intended to be heated, and a microwave source (2) connected to the wave guide, wherein the waveguide at least includes one part (1) the cross sectional area of which continuously decreases from the larger end (4) of said part located closest to the microwave source (2) to the smaller other end (5) of said part so that no reflection to the feed-in end occurs, and where the wave guide configuration along said part includes a portion between its two ends having a resultant geometry at which fed-in microwave energy no longer can propagate in said portion of said wave guide part (1), said tapered wave guide part (1) slowly and continuously decreases in cross-section to so-called propagation cut-off at said portion within said part which is at a certain distance from the smaller other end (5) of said part, and continues to slowly decrease in cross-section beyond the cut off position to the smaller other end, which distance is such that no microwave energy will leak out from the smaller end (5) of the wave guide part (1) when the wave guide is loaded with intended material to be heated.

2. A device as defined in claim 1, characterized in, that said certain distance is 20% to 60% of the length of the wave guide (1), preferably 30% to 50% of its length when the wave guide (1) is loaded with intended material.

3. A device as defined in claim 1 or 2, characterized in, that said part has a rectangular cross-section, which decreases from its one end (4) to its other end (5) and wherein each cross-section shape is uniform with the shape of remaining cross-sections.

* * * * *